United States Patent [19]

Bennett et al.

[11] Patent Number: 4,864,311

[45] Date of Patent: Sep. 5, 1989

[54] BEAM FORMING NETWORK

[75] Inventors: Frank C. Bennett; Clive W. Miller, both of Chelmsford, England

[73] Assignee: The General Electric Company, p.l.c., London, United Kingdom

[21] Appl. No.: 129,958

[22] Filed: Dec. 4, 1987

Related U.S. Application Data

[63] Continuation of Ser. No. 714,015, Mar. 19, 1985, abandoned.

[30] Foreign Application Priority Data

Mar. 24, 1984 [GB] United Kingdom ..... 8407695

[51] Int. Cl.[4] ..... H01Q 3/26

[52] U.S. Cl. ..... 342/368; 342/373

[58] Field of Search ..... 342/368–373, 342/380

[56] References Cited

U.S. PATENT DOCUMENTS

| | | | |
|---|---|---|---|
| 3,611,401 | 10/1971 | Connolly | 342/377 |
| 3,710,281 | 1/1973 | Thomas . | |
| 3,718,933 | 2/1973 | Huele | 342/373 |
| 4,041,501 | 8/1977 | Frazita et al. | 342/373 |
| 4,063,243 | 12/1977 | Anderson et al. . | |
| 4,090,199 | 5/1978 | Archer | 343/373 |
| 4,091,387 | 5/1978 | Profera | 343/373 |
| 4,101,902 | 7/1978 | Trigon | 342/374 |
| 4,117,494 | 9/1978 | Frazita | 342/368 |
| 4,316,192 | 2/1982 | Acoraci | 343/373 |
| 4,544,927 | 10/1985 | Kurth et al. | 343/373 |
| 4,584,581 | 4/1986 | Teshirogi | 343/373 |
| 4,673,942 | 6/1987 | Yokoyama | 342/368 |

FOREIGN PATENT DOCUMENTS

| | | |
|---|---|---|
| 0025265 | 3/1981 | European Pat. Off. . |
| 0028969 | 5/1981 | European Pat. Off. . |
| 2558134 | 3/1980 | Fed. Rep. of Germany . |
| 1145195 | 3/1969 | United Kingdom . |
| 1175365 | 12/1969 | United Kingdom . |
| 1503396 | 3/1978 | United Kingdom . |
| 1515371 | 6/1978 | United Kingdom . |
| 2013407 | 8/1979 | United Kingdom . |
| 2023940 | 1/1980 | United Kingdom . |
| 2084807 | 4/1982 | United Kingdom . |

*Primary Examiner*—Thomas H. Tarcza
*Assistant Examiner*—Tod Swann
*Attorney, Agent, or Firm*—Spencer & Frank

[57] ABSTRACT

A beam forming network employing a matrix of resistive coupling elements to link individual elements $E_1$ to $E_n$ of an antenna to the different phase terminals 3, 4, 5 and 6 of a phase combiner. Because of unwanted coupling between the conductive members forming the matrix it has in some circumstances been found impossible to select values of the coupling elements to give a required beam pattern. The invention solves the problem by including phase shifters in alternate lines to the antenna elements. A separate matrix and phase combiner is provided for each beam to be formed.

19 Claims, 1 Drawing Sheet

BEAM FORMING NETWORK

This application is a continuation of application Ser. No. 06/714,015, filed Mar. 19th, 1985 now abandoned.

BACKGROUND OF THE INVENTION

This invention relates to a beam forming network of the type which employs a matrix of coupling elements to link individual elements of an antenna to the different phase terminals of a phase combiner or phase splitter, hereinafter referred to as a phase combiner.

In a beam forming network of the above type unwanted interactions between the various conductive components need to be taken into consideration when selecting the values of the coupling elements, which will usually be resistive elements. However these interactions are unpredictable and therefore cannot be taken into consideration during initial calculation of their values. The procedure has therefore been adopted of initially selecting values for the coupling elements according to a calculation which ignores the aforementioned interactions; performing an experiment to determine the actual gain characteristcs, i.e., beam shape, obtained; calculating required changes to the values to correct any discrepancies between the required and actual gain characteristics, and correcting the values of the coupling elements accordingly.

The step of calculating the required corrections has itself to ignore the effect of the parasitic interactions on the correction and so the correction made is unlikely to result in exactly the required correction to the antenna gain characteristics. The procedure described in the preceding paragraph therefore has to be repeated, possibly several times, before an acceptable approximation to the required beam shape is achieved.

SUMMARY OF THE INVENTION

This invention arose when considering the design of beam forming networks required to operate at high frequencies e.g., 50 MHz or more; employing a large number of antenna elements e.g., 80 or more; and required to produce a large number, e.g., 50 or more beams. In such circumstances it has been found that the interactions previously referred to are so strong that the corrections to the resistive values, calculated without regard to these interactions, do not have the desired effect of bringing the actual beam pattern closer to that required; and sometimes have the reverse effect. It has thus been impossible in some circumstances to obtain the desired antenna characteristics. It is believed that this failure does not arise solely from inadequacy of the iterative procedure of calculating the correct values but that the strong parasitic effects do in fact make it impossible to achieve the desired antenna characteristics whatever values are chosen.

It has now been discovered that by positioning a phase inverter in alternate lines between the beam forming matrix and the antenna elements and by taking these phase inverters into consideration when calculating the required values of the coupling elements, the parasitic effects are reduced to an extent such that the iterative procedure described does work and the required antenna characteristics can be obtained.

Thus, in accordance with this invention there is provided beam forming apparatus for establishing a desired beam pattern comprising a plurality of lines connected to respective antenna elements, a plurality of channels connected to respective terminals of a combining network and a matrix of coupling elements joining the said lines to the said channels, characterised by phase shifting means for shifting the relative phase of signals on adjacent said lines and in that the physical arrangement of said lines and channels and coupling elements is such that no possible selection of values for the coupling elements could give the desired beam pattern in the absence of the phase shifting means between the matrix and the antenna elements.

It is not entirely understood why the introduction of the phase shifting means has the desired effect but it is believed that it serves to distribute the values of the coupling members in what might be considered to be a more random fashion over the matrix and that this reduces in some way the effect of interaction between different parts of the matrix.

The phase shifting means is preferably designed to shift the relative phase of signals on adjacent lines by at least the phase separation between terminals of the combining network. In these circumstances particular coupling values associated with a given said line will interchange positions with the introduction of the phase shift. This will clearly assist in the aforementioned distribution of coupling values over the area of the matrix. It should be explained here that the combining network will normally have four phase separated terminals at 0°, 90°, 180° and 270°. Alternative arrangements having just three phase separated terminals or more than four such terminals are however possible. In a preferred form of the invention a plurality of matrices are included, each arranged to join the same antenna elements to respective different combining networks. The number of combining networks correspond to the number of beams required. As a general rule the more matrices which are included the more severe is the effect of interactions and the more necessary is the technique of the present invention.

BRIEF DESCRIPTION OF THE DRAWINGS

One way in which the invention may be performed will now be described with reference to the accompanying drawings in which.

DESCRIPTION OF A PREFERRED EMBODIMENT

Figure 1:
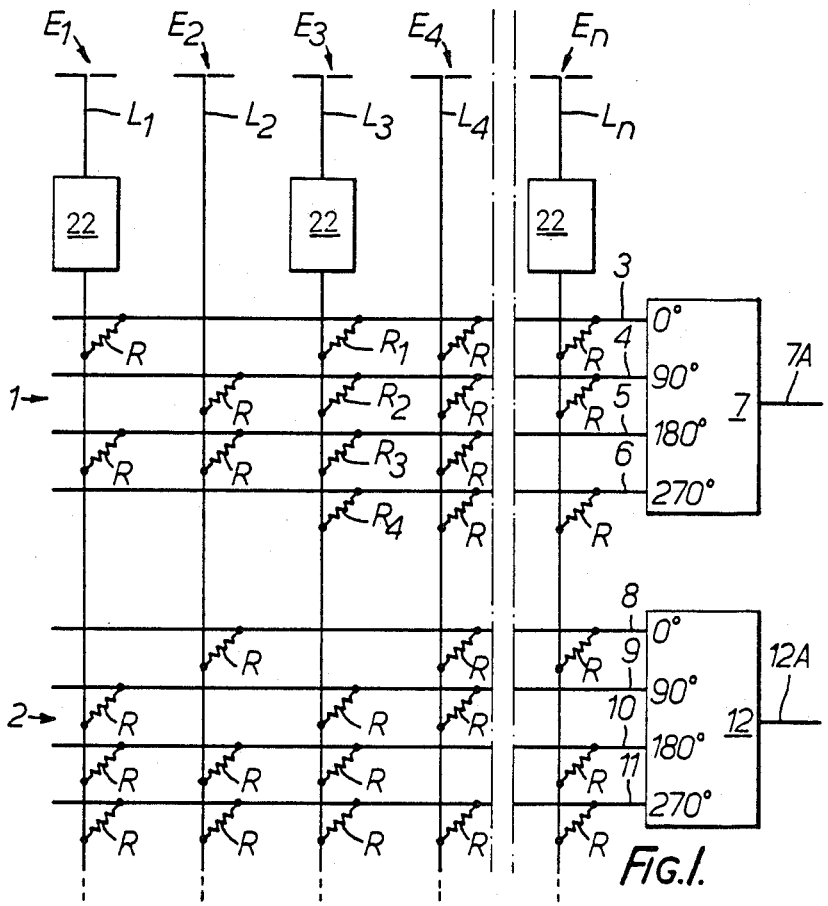
FIG. 1 illustrates schematically a stripline multiple beam forming network constructed in accordance with the invention.

Referring firstly to FIG. 1 the illustrated beam forming network comprises a number of matrices of which two are shown at 1 and 2. The matrix 1 is formed by a number of lines $L_1$ to $L_n$ connected to individual elements $E_1$ to $E_n$ of an antenna and four feed channels which are connected to respective 0°, 90°, 180° and 270° terminals of a phase combining network 7. In the illustrated embodiment the antenna elements are connected directly to the matrix but it will be understood that, in most practical forms of the invention signal frequency changing components and amplifiers will be interposed. At selected crossing points of the matrix 1 the appropriate line L is linked to the appropriate channel 3, 4, 5 or 6 by a resistive coupling element R. The second matrix 2 is formed by the lines $L_1$ to $L_n$ in co-operation with channels 8, 9, 10 and 11 connected to respective terminals of a second phase combining network 12. A large number of further matrices are included though not shown in the drawing.

Each Combining Network 7 and 12 is a five port circuit with the following characteristics:

(a) The output voltage of the fifth port 7A or 12A is proportional to the vector sum of input voltages to the other four ports 3, 4, 5 and 6 ( or 8, 9, 10, 11) and is at maximum when the four input voltages are in phase quadrature.

(b) The output of three of the input ports is substantially zero when a voltage is applied to the remaining input port.

Figure 2:
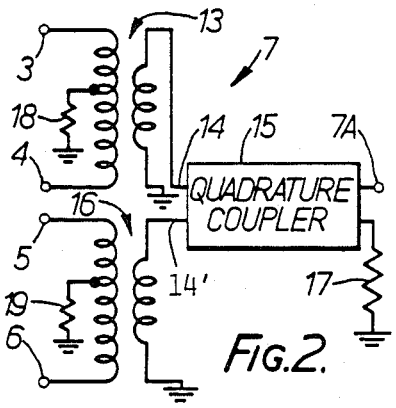
FIG. 2 illustrates, in greater detail, a phase combining network, indicated in FIG. 1 by block 7.

FIG. 2 shows the combining circuit 7 in more detail than FIG. 1. The input ports 3 and 4, are connected by a hybrid phase inverting transformer 13, to the input port 14, of the quadrature coupler 15. Input ports 5 and 6, are connected by a hybrid transformer 16, to the input port 14 of the quadrature coupler 15. The terminating resistors 18 and 19, absorb power from the unbalanced signals at inputs 3 and 4, and 5 and 6, respectively. The quadrature coupler 15, is a proprietary device manufactured by ANZAC Electronics of USA, model JH 115 being designed for use at 60 Mhz. The output at terminal 7A is at a maximum when the inputs at 14 and 17 are in phase quadrature. The terminating resistor, 14 absorbs power from the unbalanced signals at inputs 14 and 14, of quadrature coupler 15.

When the system is operating as a transmitter the signal to be transmitted enters the combining network 7 which acts as a phase splitter and produces four outputs on channels 3, 4, 5 and 6 which represent the components of the input signal which are at 0°, 90°, 180° and 270° relative to a reference phase. It can readily be appreciated that by suitably choosing the resistances R of a given matrix the phase and amplitude of the signal fed to each antenna element by that matrix can be selected thereby giving the required beam in a particular direction. Different beams will be defined by the different matrices. In other arrangements a single matrix could be employed to provide a single beam or, if provided with variable resistive elements, to produce different beams at different times.

Figure 3:
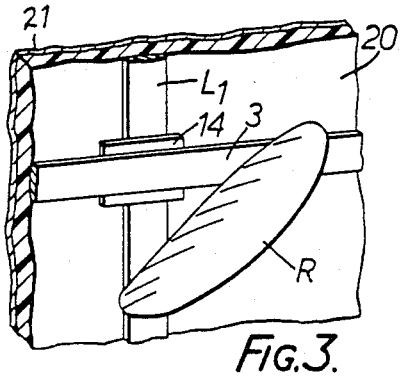
FIG. 3 illustrates in detail one of the resistive members R of FIG. 1.

In the illustrated embodiment the lines $L_1$ to $L_n$, the channels 3, 4, 5, 6, 8, 9, 10 and 11 and the resistive members R are all formed by printed circuit techniques. FIG. 3 shows in detail one printed resistive element R serving to connect line $L_1$ to channel 3. The latter are printed on an insulating medium in the form of a sheet 20 having a conductive ground plane 21 on one side and the conductors $L_1$ and 3 on the opposite side. A printed insulating layer 14 is interposed between the condcutors $L_1$ and 3. Whilst conductive members of the illustrated embodiment are formed by printed circuit techniques, any other conventional possibility can of course be employed.

Reverting now to FIG. 1 it will be noted that, in alternate lines $L_1$ to $L_n$, a phase shifter 22 is included. This is in the form of a transformer though of course in other embodiments different means could be employed for the same purpose. Each of phase shifters 22 is designed to impose a 180° phase shift on a signal passing in either direction through it. The effect of this is that, considering for example line $L_3$, resistors $R_1$ and $R_3$ on the one hand, and similarly resistors $R_2$ and $R_4$ on the other hand are interchanged in position relative to the positions that they would have to have adopted had the phase shifter not been in position. This serves to distribute the resistance values more evenly over the circuit board thereby, it is believed, reducing the effects of parasitic coupling as previously mentioned.

In the illustrated embodiment of the invention the "channels" and lines are each formed by spaced parallel conductors e.g., conductive ground plane 21 in co-operation with $L_1$ or ground plane 21 in co-operation with conductor 3. These conductors being spaced by, and preferably supported by an insulating medium 20. The invention is particularly concerned with such constructions since the risk of parasitic coupling is much greater than in waveguide systems where undesired coupling may be insignificant and which may in any case be impracticable where a very large number of beams and/or antenna elements are required. The invention would however also be applicable to systems employing balanced transmission lines when the ground plane 21 is replaced by conductors like those shown at 3 to 11 and $L_1$ to $L_n$ and directly opposite them. It would likewise be applicable to a triplate construction where the conductors 3 to 11 and $L_1$ to $L_n$ are sandwiched between two ground planes with the interposition of two respective dielectric sheets. Likewise, the conductors 3 to 11 and $L_1$ to $L_n$, whilst being most conveniently made by a printing process are not necessarily so produced. They could for example be formed by wires embedded in slots in the insulating sheet 20.

We claim:

1. Beam forming apparatus for establishing a desired beam pattern comprising a plurality of lines connected to respective antenna elements, a plurality of channels connected to respective terminals of a combining or splitting network and a matrix of coupling elements joining the said lines to the said channels, wherein the improvement comprises phase shifting means between the matrix and antenna elements for shifting the relative phase of signals on adjacent said lines and in that the physical arrangement of the said lines and channels and coupling elements is such that no possible selection of values for the coupling elements could give the desired beam pattern in the absence of the said phase shifting means.

2. Beam forming apparatus according to claim 1 in which each line and channel comprises at least a pair of conductors separated by a dielectric.

3. Beam forming apparatus according to claim 2 in which the conductors of a pair are separated and supported by a dielectric sheet.

4. Beam forming apparatus accordig to claim 1 characterised in that the phase shifting means shifts the relative phase of signals on adjacent said lines by at least the phase separation between terminals of the combining or splitting network.

5. Beam forming apparatus according to claim 1 comprising a plurality of matrices each arranged to join the same antenna elements to a respective different combining or splitting network.

6. Beam forming apparatus according to claim 1 characterised in that the said lines and channels and coupling elements are printed on the same insulating medium.

7. Beam forming apparatus according to claim 2 characterised in that the phase shifting means shifts the relative phase of signals on adjacent said lines by at least the phase separation between terminals of the combining or splitting network.

8. Beam forming apparatus according to claim 3 characterised in that the phase shifting means shifts the relative phase of signals on adjacent said lines by at least the phase separation between terminals of the combining or splitting network.

9. Beam forming apparatus according to claim 2 comprising a plurality of matrices each arranged to join the same antenna elements to a respective different combining or splitting network.

10. Beam forming apparatus according to claim 3 comprising a plurality of matrices each arranged to join the same antenna elements to a respective different combining or splitting network.

11. Beam forming apparatus according to claim 4 comprising a plurality of matrices each arranged to join the same antenna elements to a respective different combining or splitting network.

12. Beam forming apparatus according to claim 2 characterised in that the said lines and channels and coupling elements are printed on the same insulating medium.

13. Beam forming apparatus according to claim 3 characterised in that the said lines and channels and coupling elements are printed on the same insulating medium.

14. Beam forming apparatus according to claim 4 characterised in that the said lines and channels and coupling elements are printed on the same insulating medium.

15. Beam forming apparatus according to claim 5 characterised in that the said lines and channels and coupling elements are printed on the same insulating medium.

16. A beam forming apparatus for establishing a desired beam pattern comprising:

a plurality of lines, each of said lines being connected to a corresponding antenna element;

a plurality of channels;

a network having an output terminal and a plurality of input terminals each connected to a corresponding one of said plurality of channels, a voltage being generated at the output terminal of said network which is proportional to the vector sum of voltages applied to the input terminals thereof;

a matrix of coupling elements joining predetermined lines of said plurality of lines to predetermined channels of said plurality of channels; and a plurality of phase shifters located in the lines between said antenna elements and said matrix, whereby said phase shifters provide a desired beam pattern for given values of the coupling elements in said matrix.

17. A beam forming apparatus according to claim 16 wherein only each alternate line of said plurality of lines contain a phase shifter.

18. A beam forming apparatus according to claim 16 wherein each of said phase shifters shifts the phase of a signal passing in either direction therethrough by 180°.

19. A beam forming apparatus according to claim 17 wherein each of said phase shifters shifts the phase of a signal passing in either direction therethrough by 180°.

* * * * *